United States Patent [19]

Landgarten

[11] 4,352,368

[45] Oct. 5, 1982

[54] PLUMBING APPARATUS

[75] Inventor: Gerald Landgarten, Framingham, Mass.

[73] Assignee: Sanitary-Dash Manufacturing Company, Inc., North Grosvenor Dale, Conn.

[21] Appl. No.: 260,385

[22] Filed: May 4, 1981

Related U.S. Application Data

[63] Continuation-in-part of Ser. No. 865,972, Dec. 30, 1977, abandoned.

[51] Int. Cl.[3] ..... F16K 9/00

[52] U.S. Cl. ..... 137/247.45; 137/247.49; 4/207; 4/DIG. 14; 285/332; 277/205; 277/236

[58] Field of Search ..... 137/247.41, 247.45, 137/247.49; 285/332; 277/191, 236, 205; 4/207, DIG. 13, DIG. 14

[56] References Cited

U.S. PATENT DOCUMENTS

| | | | |
|---|---|---|---|
| 295,908 | 4/1884 | Dark | 137/247.45 |
| 441,691 | 12/1890 | McClellan | 137/247.49 |
| 3,288,472 | 11/1966 | Watkins | 277/205 X |
| 3,301,576 | 1/1967 | Vigueron | 285/332 X |

*Primary Examiner*—Harold W. Weakley

[57] ABSTRACT

A continuous, synthetic plastic plumbing trap comprising a generally U-shaped tubular structure having a first opening comprising an outer threaded annular rim, which is adapted to form a seal with an outer rim surface of a downstream tubular member, and an inner annular rim which is adapted to form a seal with an inner rim surface of a downstream tubular member, the inner and outer annular rims of the trap opening being so situated as to accommodate any tubular downstream member having a rim which fits between the inner surface of the threaded annular rim and the inner annular rim; and a second opening comprising a threaded annular rim, both said threaded annular rims being adapted to engage fastening means of the same size.

4 Claims, 8 Drawing Figures

PLUMBING APPARATUS

This is a continuation-in-part of pending U.S. Patent Application Ser. No. 865,972, filed on Dec. 30, 1977 abandoned.

BACKGROUND OF THE INVENTION

The plumbing industry has long recognized the benefits which are derived by employing a trap between a source of refuse liquid and a conduit to a sewer or holding system. Such traps are commonly found running, for example, from the tail pipe of a sink to a drain pipe which may empty into a sewerage system.

A conventional trap is generally tubular, fabricated of metal or synthetic plastic, and comprises a U-bend. The inlet leg of the U, that is the leg which may connect to a tail pipe, leading from, for example, a sink, is usually longer than the outlet leg of the U giving the trap configuration a J-shape. The union between the trap and the downstream member is accomplished usually by fabricating the trap member with male threads and providing a female threaded fastening means which engages a flange or bead on the other member so that the fastening of the female threaded means to the male threads, in place, with a rubber seal, if necessary, provides a generally leak-proof union.

The tail pipe engages the trap inlet (upstream) opening and generally fits into the opening a short distance. The inlet opening comprises a threaded annular rim which co-acts with a compression ring which holds the tail pipe securely in place when pressure is applied by tightening a tail pipe-encompassing fastening means against the ring.

In use, the plumbing trap serves the purpose of not only inter-connecting a pipe leading from a source of refuse liquid to a drain pipe, but acts as an odor and vapor barrier when liquid is not being conducted therethrough. The lowermost portion of a trap comprises the U-bend, the inlet and outlet openings being located thereabove. Accordingly, water running into the trap from a tail pipe falls to the lowest point in the trap, the U-bend, before running up to the drain pipe inlet. Stimulus for movement of the liquid in this fashion is the head of liquid in the tail pipe and inlet arm of the trap. When liquid ceases to enter the tail pipe and trap inlet arm, the liquid in the U-bend equilibrates and fills the U-bend with standing liquid which prevents fumes and odors from passing from the drain pipe to the tail pipe and into the ambient environment.

One improvement in the joining surfaces between a synthetic plastic trap and a downstream member (drain pipe) which is known, comprises the double seal design downstream trap opening. In this design the outlet opening of the trap comprises an annular rim which has twin surfaces capable of mating with complimentary surfaces of a downstream member, thereby providing the double seal. This design, however, has significant drawbacks.

In particular, due to fabrication problems, the threaded portion of the double seal end of the trap was never made the same threaded diameter as the threaded upstream end. This required different diameter fastening means for each end of the trap and did not permit the trap to be used with, for example, a conventional brass downstream member due to the oversized nature of the downstream threaded end of the trap and concomitant oversized nature of the double seal surfaces.

British Patent Specification No. 487,796, accepted June 24, 1938, ussued to Mott, is the first description of a double seal configuration in a conduit union. Mott uses the double seal union in a pressurized beer distribution system. The double seal terminal is soldered or screwed to the conduit and in no sense can the device of Mott be considered a continuous structure. Mott neither teaches the use of the double seal connection in non-pressurized situations nor does he anticipate incorporating a J- or U-configuration into his conduit tubing. Such a configuration would obviously serve no purpose in the Mott device.

U.S. Pat. No. 3,719,209, issued Mar. 6, 1973, to Rush et al. claims a tubular trap formed by a particular blow molding technique which comprises:

(1) extruding a parison of molten plastic and clamping it between die members having the configuration of the extended shape of the article to be molded (Rush et al., FIG. 4);

(2) introducing blow-molding ducts into the die members and parison to assist in forming the article configuration and provide air under pressure to force the parison against the sides of the mold until the plastic has cooled (Rush et al., FIG. 3); and (3) parting the die members and stripping the molded article from the mold.

Rush's et al. contribution to technology did not lie in the particular configuration molded, but in the step of using positive pressure to conform the parison walls to the die configuration. As a matter of fact Rush's et al. claims are couched in product by process format. It will be apparent from the configuration of the trap claimed herein that it could not be fabricated by the Rush et al. method since the falling parison technique cannot be utilized to form the double seal configuration on the downstream end of the trap of the present invention (see, for example, FIG. 8 of Rush et al.).

SUMMARY OF THE INVENTION

It is accordingly an object of the present invention to produce a continuous synthetic plastic plumbing trap which obviates many of the drawbacks of the prior art. In particular it is an object of the present invention to provide a continuous synthetic plastic trap which is not only adapted to mate with a downstream plastic member and provide a double seal against leakage; but which is capable of providing a leak-proof union with a metallic downstream member having a beaded inlet opening of a diameter between the inner and outer diameters of the double-sealing surfaces.

It is another object of the present invention to provide a synthetic plastic plumbing trap which comprises a double rimmed outlet opening to accommodate the surface of an annular rim of a mating inlet opening of a synthetic plastic downstream member.

It is an additional object of the present invention to provide a plumbing trap as described above, which can be mated with a standard metallic downstream tubular member.

It is still a further object of the present invention to provide a synthetic plastic plumbing trap of a double seal design which comprises a threaded outlet opening annular rim to which a downstream member may be fastened by an internally threaded means which encompasses a circumferential portion of the downstream member.

It is another object of the present invention to provide a continuous synthetic plastic plumbing trap having a generally J-shaped configuration wherein both ends of the trap are externally threaded (male threads) and are of the same diameter, whereby female threaded fastening means of the same size provide mating unions with the externally threaded ends.

It is a further object of the present invention to provide a double seal, continuous, synthetic plastic plumbing trap wherein the inside diameter of the tubular conduit in the U-bend portion of the trap decreases as a function of distance from the double seal or downstream end of the trap.

As has been mentioned, the trap which comprises the present invention is molded of synthetic plastic materials. Preferred materials are PVC (polyvinyl chloride) ABS (acrylonitrile-butadiene-styrene), and polypropylene, though other synthetic plastics may be employed. The actual molding is accomplished with conventional injection molding equipment well known to the art. The apparatus and technique employed to produce the present invention will be discussed below.

DETAILED DESCRIPTION OF THE INVENTION

Figure 1:
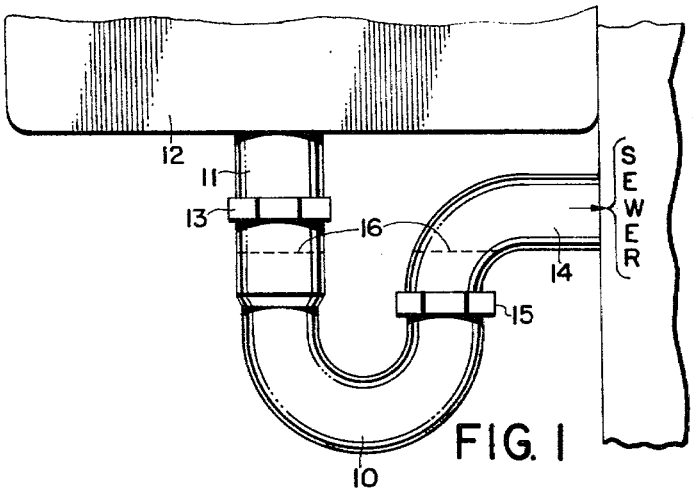
FIG. 1 is a view of the trap of the present invention in use with a downstream member.

FIG. 1 illustrates a typical environment in which the present invention will be employed. The trap of the present invention 10 is shown connected to tail pipe 11 which carries liquid refuse material from container 12, which may be a sink or the like. Trap 10 attaches to tail pipe 11 through a compression ring (not shown) and pressure applying fastening means 13. Downstream member 14 connects to the outlet opening of the trap 10 by means of fastening means 15 and conducts the refuse liquid into a drain pipe leading to, for example, a sewer. Dotted lines 16 depict a level of standing liquid which is established in the trap when liquid is not being conducted therethrough to prevent moxious fumes and odors from backing up from the sewer through sink 12.

Figure 2:
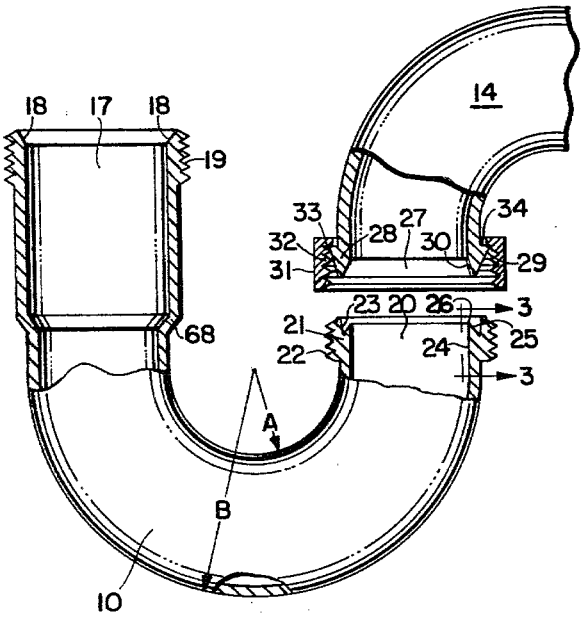
FIG. 2 is a partially cut-away exploded view of the trap of the present invention and a downstream member.
Figure 3:
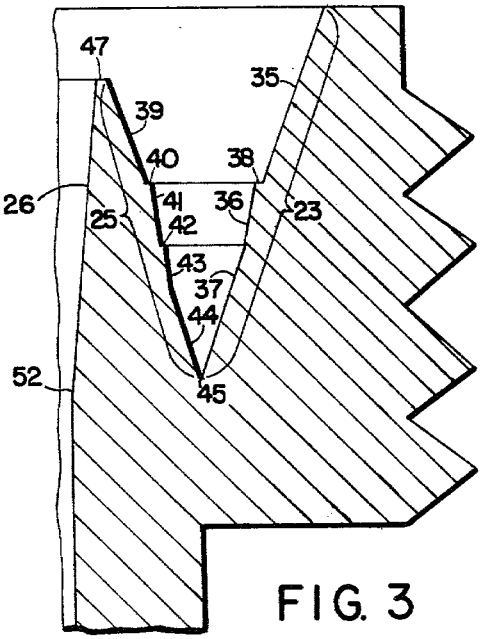
FIG. 3 is a detailed sectional view of the double seal cross-sectional configuration of the trap of the present invention through 3—3 of FIG. 2.
Figure 6:
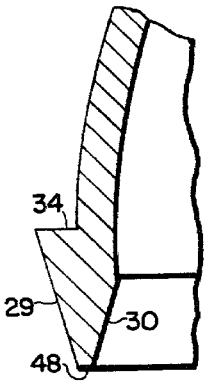
FIG. 6 is a sectional side view of the inlet rim cross-section of a downstream member surface adapted to mate with the trap of the present invention.

FIG. 2 is a partially sectioned side view of the trap 10 of the present invention and downstream member 14. Trap inlet opening 17 is shown larger in diameter than the remainder of the trap by about two wall thicknesses to accommodate the insertion of the tail pipe into the inlet. Threads 19 co-act with a threaded fastening means (not shown) which acts upon a standard annular compression fitting (not shown) against annular surface 18. Outlet opening 20 comprises outer annular rim 21 which comprises threaded outer surface 22 and inner bearing surface 23. Inner annular rim 24 comprises outer surface 25 which joins the inner surface 23 of the outer rim 22 in a generally female V-shaped cross-section. The specific cross-section preferred for these bearing surfaces is shown in FIG. 3 and described hereinbelow. The inner surface 26 of the inner rim 24 is a continuation of the inside surface of the trap tube, which is a circular cross-sectional configuration, and which flares slightly from a point generally adjacent the double seal configuration to a slightly greater diameter at the double seal opening. This will be further amplified in the description of FIG. 3. The inlet opening 27 of the downstream member 14 is configured with annular rim 28 which comprises outer bearing surface 29 and inner bearing surface 30 which join each other in a generally male V-shaped cross-section, the specifics of which are shown in FIG. 6 hereinbelow. Annular rim 28 fits into and co-acts with the generally female V-shaped configuration of the trap outlet opening to form a double seal against leakage. Fastening means 31 has female threads 32 which co-act with male threads 22, and a bearing surface 33 which bears against rim flange 34 to secure the trap to the downstream member.

The enlarged diameter inlet trap opening extends preferably for about two inches to shoulder 68 and is preferably about 1.508 inches in diameter. The inside diameter of the arcuate section of the trap is preferably not constant and will extend from about 1.250 inches in the arcuate section just below shoulder 68, to about 1.350 inches in the arcuate section just below the double seal area, with wall thicknesses increasing from about 0.075 inch at the double seal end to 0.125 inch just below shoulder 68. The reason for the gradual change in inside diameter will be explained below with respect to the preferred method of fabrication of the trap of the present invention. The wall thickness in the enlarged inlet area is preferably about 0.070 inch and annular shoulder 68 is about 0.090 inch in thickness and forms an angle of about 45 degrees. The radius of curvature A of the inside U-bend is preferably about 0.875 inch and the radius of curvature B of the outside of the U-bend is preferably about 2.375 inches. The outer diameter of threaded rim 21 is on the order of 1.870 inches.

FIG. 3 is a detailed enlarged cross-sectional view of the double seal trap outlet opening through 3—3 of FIG. 2 and depicts the preferred configuration thereof. Outer rim inner bearing surface 23 preferably comprises four separate surfaces, 35, 36, 37 and 38. Surfaces 35 and 37 are preferably parallel and at an angle of about 19 degrees to the vertical. Shoulder 38 is horizontal and surface 36 is substantially less than 19 degrees to the vertical. Bearing surface 25 of inner rim 24 preferably comprises six separate surfaces 39, 40, 41, 42, 43 and 44. Surfaces 39 and 44 are preferably parallel and about 15 degrees from the vertical. Shoulders 40 and 42 are preferably horizontal and surfaces 41 and 43 are substantially less than 15 degrees to the vertical. The preferred vertical dimension from point 45 at which the two bearing surfaces meet to the top of bearing surface 35 is about 0.220 inch, and the preferred vertical dimension from point 45 to the top of bearing surface 39 is about 0.190 inch. The following are preferred vertical dimensions for certain of the recited bearing surfaces;

surface 36, 0.040 inch; surface 41, 0.040 inch; surface 43; 0.016 inch, surface 37, 0.100 inch; surface 44, 0.084 inch; and surface 39, 0.050 inch. The preferred dimensions of shoulders 47, 40, 42 and 38 are, respectively, 0.020, 0.006, 0.003 and 0.008 inch.

Inner trap wall 26 is shown slightly exaggerated to depict the fact that from the point at which that surface transitions from an arcuate structure to a straight run, the tube diameter is configured to flare outward, or continuously enlarge until it terminates at 47. That transition takes place at about 52, at which point the preferable tube diameter would be about 1.350 inches and flare to form a preferably diameter of about 1.365 inches at 47, the terminal segment of the inner rim of the double seal configuration.

Figure 4:
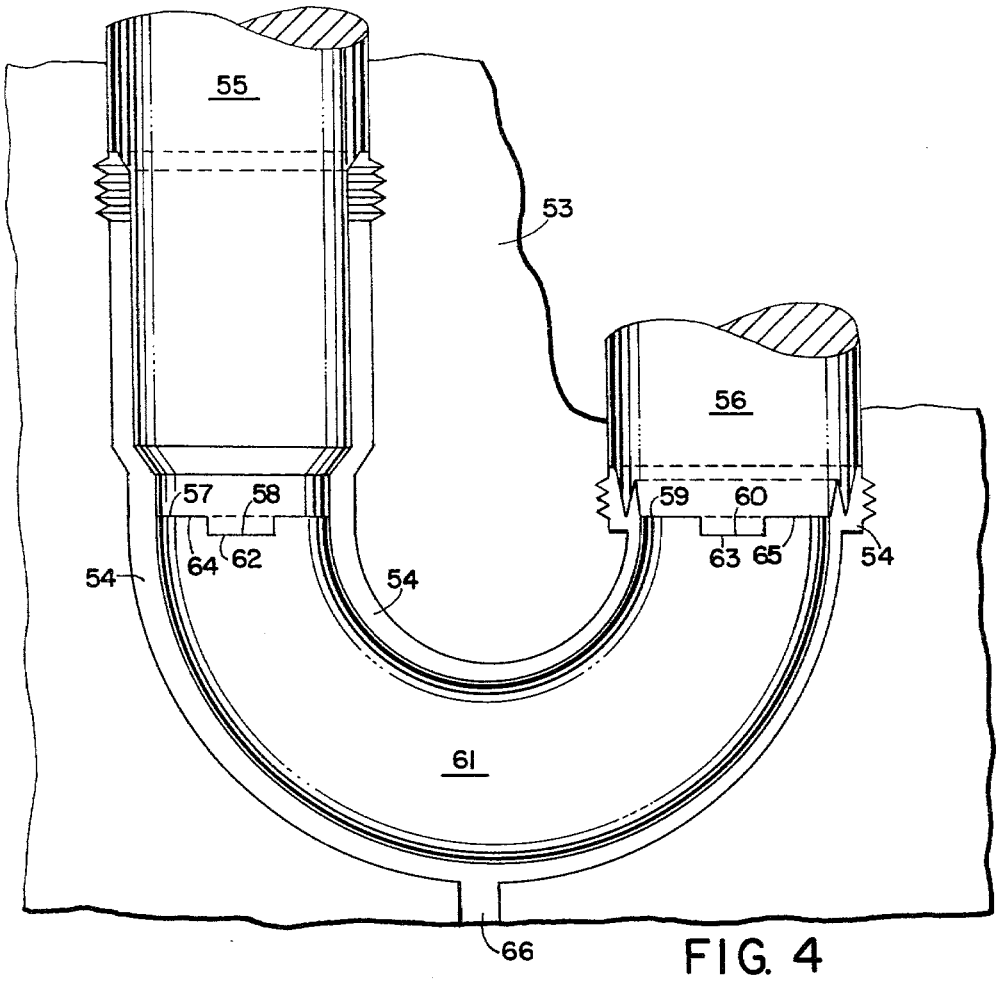
FIG. 4 is a cut-away side view of the trap of the present invention depicting part of the molding apparatus employed in its fabrication.

FIG. 4 is a view of a typical injection molding apparatus by which the trap of the present invention may be fabricated and is limited to those components which provide the configuration of the plumbing trap claimed herein. Die member 53, which is one of two mating die members (the second of which is not shown) contains a die cavity, 54, which defines the exterior configuration of the trap. Elements 55 and 56 invade the die cavity within channels provided for that purpose and define the internal configurations of the ends of the trap. Element 55 defines the internal configuration of the enlarged end of the trap to a point just beyond shoulder 68, as shown in FIG. 2, and terminates at surface 57, which comprises a cylindrical, elevated portion, 58. Element 56 defines the double seal configuration of the trap of the present invention and terminates at surface 59, which comprises a cylindrical elevated portion, 60. Extending between elements 55 and 56 and mated therewith is element 61, which defines the arcuate portion of the trap, elements 55 and 56 being definitive of the straight run portions. The mating is accomplished through depressions 62 and 63 in surfaces 64 and 65 which co-act with elevated portions 58 and 60 to form a structure which, when in place between die member 53 and its mate, define the cavity conforming to the three-dimensional configuration of the present invention. Molten plastic is injected under high pressure through port 66 to fill the cavity. After the plastic cures the die members are opened and elements 55 and 56 are withdrawn, leaving element 61 encased in the cured, continuous, synthetic plastic trap of the present invention.

Figure 5:
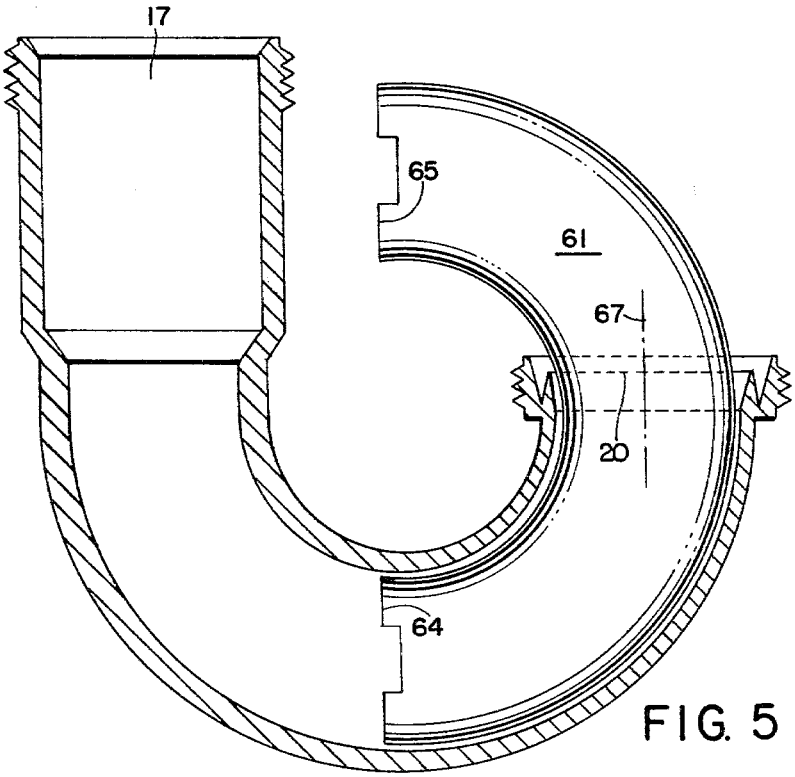
FIG. 5 is a side perspective view of the trap of the present invention depicting removal of the molding insert after fabrication.

FIG. 5 is a cross-sectional side view of a trap of the present invention depicting the removal of element 61 after fabrication of the trap and withdrawal of elements 55 and 56. Element 61 is dislodged by applying a force to surface 64. When element 61 is dislodged, it proceeds freely out of the tubular cavity of the molded trap until surface 65 reaches the trap end at opening 17. Travel of element 61 through the molded trap is significantly enhanced by the continuously increasing inside diameter of the trap in its arcuate portion, with the largest diameter at the double seal end. As element 61 proceeds out of the molded trap, more and more clearance is established between its surface and the inner surface of the trap. The change in inside diameter of the trap combined with the flare of the surface of the double seal element coincident with the inside surface of the trap (see FIG. 3) permit the operator to twist element 61 about an axis of rotation 67, perpendicular to double seal opening 20, which provides enough clearance for element 61 to avoid contact with the trap end at opening 17 so that it can be withdrawn. The flare at the double seal portion surface coincident with the inner surface of the trap essentially extends the arcuate feature of the tubular structure into the double seal straight run area to permit rotation of element 61 out of the molded stucture without presenting an inhibition to movement which, if overcome by force, might damage the molded part.

FIG. 6 is a detailed cross-sectional view of annular rim 28 of inlet opening 27 of a typical synthetic plastic downstream member 14. Inner bearing surface 30 meets outer bearing surface 29 at shoulder 48. Bearing flange 34 is perpendicular to the vertical and surfaces 29 and 30 are preferably 15 degrees and 19 degrees to the vertical to compliment the configuration of the trap outlet. Surface 48 is preferably about 0.005 inch; surface 29 about 0.377 inch, and flange 34, about 0.125 inch.

Figure 7:
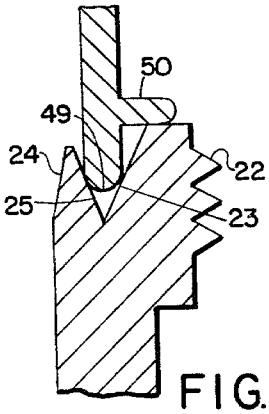
FIG. 7 is a sectional side view of a portion of the double seal exit opening of the trap of the present invention joined to the lip of a beaded metallic downstream member.

FIG. 7 depicts an inside cross-section of the double seal outlet opening of the present invention conjoined with a conventionally beaded metallic downstream member made of, for example, brass. While the double seal functionality achieved with downstream member 14 is not as effective with a conventionally beaded metallic downstream member, nonetheless, a seal with leakproof integrity will be achieved. Portion 49 of the downstream member fits between bearing surfaces 23 and 25 of the outlet opening of the trap. The downstream member is fastened securely to the trap by means of a conventional annular female threaded means (not shown) and rubber washer (not shown) co-acting with threads 22 and bearing against surface 50. This interchangeability function, which provides the present invention with a dramatic range of uses with various wall pipes, or downstream members, will be achieved as long as the joining surface of the downstream tubular member has a tube diameter somewhere between the largest diameter of annular bearing surface 23 and the smallest diameter of annular bearing surface 25. Even though sealing contact may be made only at one or the other bearing surfaces and not both, nonetheless a high integrity leakproof seal may be formed.

Figure 8:
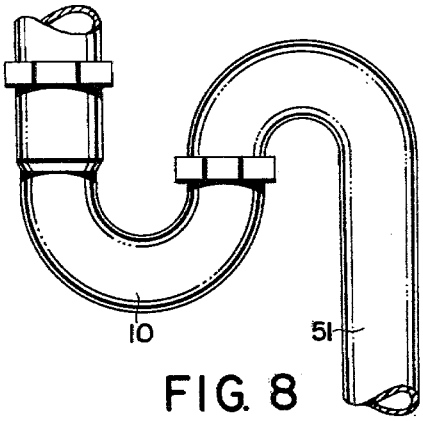
FIG. 8 is an alternate downstream member configuration in conjunction with the trap of the present invention.

FIG. 8 depicts another downstream member configuration 51 which bends 180 degrees instead of the 90 degrees shown for downstream member 14. This would lead, for example, to a floor drain rather than a wall drain.

It will be appreciated that the trap of the present invention provides the functionality of a double seal against leakage when employed with a downstream member having a predetermined complimentary inlet opening configuration; and can be employed with a conventional, beaded metallic downstream member. Its unique configuration renders it subject to fabrication by conventional injection molding techniques. It provides double seal trap functionality wherein both threaded ends are the same diameter, thereby facilitating the employment of the same size fastening means on each end. While preferable dimensions have been provided to conform the trap to a standard use, it is well within the expertise of one of ordinary skill in this art to enlarge or diminish the trap size and employ fabrication apparatus the dimensions of which are empirically determined.

What is claimed is:

1. A tubular trap adapted to conduct liquids, interconnect an upstream, tubular, liquid-conducting member to a downstream, tubular, liquid-conducting member and retain a pool of trapped liquid when liquid is not being conducted therethrough:

said trap comprising a tubular structure having an inside and an outside surface and a generally U-shaped bend;

a first opening at one end; and a second opening at the other end;

said first opening comprising a threaded outer annular rim having an inner annular bearing surface adapted to intimately contact a mating surface of an inlet opening of a downstream liquid conducting member; and an inner annular rim having an outer bearing surface adapted to intimately contact a mating surface of an inlet opening of a downstream liquid-conducting member; said inner bearing surface of said outer annular rim and said outer bearing surface of said inner annular rim together forming a generally V-shaped cross-sectional configuration;

said inner and outer annular rims of said first opening of said trap being situated with respect to one another as to permit said first opening of said trap member to be fastened to an inlet opening of a downstream member which comprises an annular inlet rim element having a diameter between the largest diameter of said inner annular bearing surface of said outer annular rim and the smallest diameter of said outer annular bearing surface of said inner annular rim of said trap, whereby intimate contact between the inner surface of the outer annular rim of the trap with a mating surface of the inlet opening of a downstream liquid-conducting member, and intimate contact between the outer surface of the inner annular rim of the trap with a mating surface of the inlet opening of a downstream liquid-conducting member provides a double seal against leakage when said first opening of said trap is fastened to the inlet opening of a downstream member;

said second opening of said trap comprising a threaded annular rim having a diameter equal to the diameter of the threaded annular rim of said first opening so that both threaded annular rims are adapted to be engaged by fastening means of the same size.

2. The trap of claim 1 wherein the vertical dimension from the lowermost portion of said generally U-shaped bend to said first opening of said trap is less than the vertical dimension from the lowermost portion of said generally U-shaped bend to said second opening, thereby producing a generally J-shaped trap configuration.

3. The trap of claim 1 wherein the U-shaped bend comprises a constant outside diameter and a continuously increasing inside diameter from the portion of said bend closest to the second opening of said trap to the portion of said bend closest to the first opening of said trap.

4. The trap of claim 3 wherein the surface of the inner annular rim comprising said first opening is coincident with the inside surface of said trap and continuously flares to a diameter greater than the largest inside diameter in the U-shaped bend of the trap.

* * * * *